US012075951B2

(12) United States Patent
Downey

(10) Patent No.: US 12,075,951 B2
(45) Date of Patent: Sep. 3, 2024

(54) DISPENSING ASSEMBLY FOR A TOILET PAPER AND WATER

(71) Applicant: Kevin Downey, DC NE., WA (US)

(72) Inventor: Kevin Downey, DC NE., WA (US)

( * ) Notice: Subject to any disclaimer, the term of this patent is extended or adjusted under 35 U.S.C. 154(b) by 116 days.

(21) Appl. No.: 17/674,538

(22) Filed: Feb. 17, 2022

(65) Prior Publication Data

US 2022/0338685 A1 Oct. 27, 2022

Related U.S. Application Data

(60) Provisional application No. 63/179,717, filed on Apr. 26, 2021.

(51) Int. Cl.
*A47K 10/38* (2006.01)
*A47K 10/32* (2006.01)

(52) U.S. Cl.
CPC ..... *A47K 10/38* (2013.01); *A47K 2010/328* (2013.01); *A47K 2010/389* (2013.01)

(58) Field of Classification Search
CPC ..... A47K 2010/328; A47K 2010/389
See application file for complete search history.

(56) References Cited

U.S. PATENT DOCUMENTS

| | | | | |
|---|---|---|---|---|
| 5,312,021 | A * | 5/1994 | Nelson | A47K 10/32 239/289 |
| 2014/0224893 | A1* | 8/2014 | Finch | B05B 15/62 239/69 |
| 2020/0015638 | A1* | 1/2020 | Peterson | A47K 10/32 |

* cited by examiner

*Primary Examiner* — Natasha N Campbell
(74) *Attorney, Agent, or Firm* — Barry Choobin; Patent 360

(57) ABSTRACT

A dispensing assembly and a method for cleaning inner buttocks using partially wet toilet paper. The dispensing assembly includes a housing and a container removably coupled to the bottom of the housing. The container can be removed, refilled, and reattached to the housing. A pump enclosed within the housing can suck liquid from the container. The pump can deliver a stream of liquid through a nozzle on the toilet paper. Sensors protruding from the housing can detect the toilet paper when in proximity to the nozzle.

10 Claims, 7 Drawing Sheets

DISPENSING ASSEMBLY FOR A TOILET PAPER AND WATER

CROSS-REFERENCE TO RELATED APPLICATIONS

This application claims priority from the U.S. provisional patent application Ser. No. 63/179,717, filed on Apr. 26, 2021, which is incorporated herein by reference in its entirety.

FIELD OF INVENTION

The present invention relates to a water dispensing assembly, and more particularly, the present invention relates to a toilet paper and water dispensing assembly and a method for keeping the inner buttocks hygiene.

BACKGROUND

Maintaining good anal hygiene is important for health, wellbeing, and preventing odor. Post defecation, the anal area including the inner buttocks must be cleaned to remove any residues. Two methods for cleaning the anal area and the inner buttocks are common in most countries i.e., rinsing with water and wiping with dry material, such as toilet paper. In western countries, wiping with dry toilet paper is both traditional and standard for anal area hygiene. Wiping with toilet paper, also referred to herein as tissue paper, has certain advantages over rinsing with water, however, the use of dry toilet paper can be harsh to the skin. Excessive or hard wiping can make the skin itchy and irritated. Moreover, depending upon bowels, the toilet paper cannot adequately clean the inner buttocks leaving behind traces or streaks of feces.

Disposable Wet tissue papers and wipes are also well known for cleaning the skin, in particular, that of the face and hands. The wet wipes include chemicals and alcohol and have poor absorbency. They spread and smear the residue, making it more difficult to clean. Wetting the dry tissue paper with water from a tap or a container can make the whole tissue paper wet and wet tissue paper crumbles into small pieces forming a wet ball. Pieces from the wet tissue paper easily break apart and stick to the inner buttocks.

Thus, a need is appreciated for an improved method from cleaning the anal area and inner buttocks post defecation.

The "inner buttock" hereinafter includes the anal area and the skin around the anal area.

The "tissue paper" and "toilet paper" are interchangeably used hereinafter and refer to any absorbent paper known to a skilled person for cleaning the skin.

SUMMARY OF THE INVENTION

The following presents a simplified summary of one or more embodiments of the present invention to provide a basic understanding of such embodiments. This summary is not an extensive overview of all contemplated embodiments and is intended to neither identify key or critical elements of all embodiments nor delineate the scope of any or all embodiments. Its sole purpose is to present some concepts of one or more embodiments in a simplified form as a prelude to the more detailed description that is presented later.

The principal object of the present invention is therefore directed to a dispensing assembly for dispensing dry toilet paper and a stream of liquid.

It is another object of the present invention to improve anal hygiene without irritating the skin.

It is still another object of the present invention that the inner buttocks are cleaned without leaving any residue.

It is yet another object of the present invention that the repeated wiping of inner buttocks can be avoided.

It is a further object of the present invention that the dispensing assembly can be economical to manufacture.

It is still a further object of the present invention that a liquid container of the dispensing assembly containing the liquid can be cleaned and refilled.

In one aspect, disclosed is a dispensing assembly for toilet paper and liquid, and a method for maintaining anal hygiene. The toilet paper can be any dry absorbent paper in the form of a roll of sheets or a stack of interleaved sheets. The method includes the steps of tearing a piece of toilet paper from dispensing assembly. Corrugating the toilet paper by hands and partially wetting the corrugated toilet paper through a stream of liquid dispensed from the dispensing assembly.

In one aspect, 25 to 50% of the toilet paper can be made wet by the stream of liquid.

In one aspect, the liquid dispenser can include sensors to detect the presence of toilet paper in the proximity of a nozzle of the dispensing assembly. The nozzle can be configured to dispense a focused stream of liquid, preferably as a mist or fine droplets of liquid, and the dispensing assembly can be configured to dispense just the right amount of the liquid to partially wet a middle portion of the piece of the toilet paper.

In one aspect, the sensor can be a motion sensor that can detect movement of the hand or the toilet paper in proximity to the nozzle.

In one aspect, disclosed is a method for wiping the inner buttocks using partially wet toilet paper.

In one aspect, the dispensing assembly can include a refillable container for the liquid, wherein the refillable container can be removed, cleaned, refilled, and then replaced.

In one aspect, a water treatment filter can also be incorporated to treat water in the refillable container.

BRIEF DESCRIPTION OF THE DRAWINGS

The accompanying figures, which are incorporated herein, form part of the specification and illustrate embodiments of the present invention. Together with the description, the figures further explain the principles of the present invention and to enable a person skilled in the relevant arts to make and use the invention.

DETAILED DESCRIPTION

Subject matter will now be described more fully hereinafter with reference to the accompanying drawings, which form a part hereof, and which show, by way of illustration, specific exemplary embodiments. Subject matter may, however, be embodied in a variety of different forms and, therefore, covered or claimed subject matter is intended to be construed as not being limited to any exemplary embodiments set forth herein; exemplary embodiments are provided merely to be illustrative. Likewise, a reasonably broad scope for claimed or covered subject matter is intended. Among other things, for example, the subject matter may be embodied as methods, devices, components, or systems. The following detailed description is, therefore, not intended to be taken in a limiting sense.

The word "exemplary" is used herein to mean "serving as an example, instance, or illustration." Any embodiment described herein as "exemplary" is not necessarily to be construed as preferred or advantageous over other embodiments. Likewise, the term "embodiments of the present invention" does not require that all embodiments of the invention include the discussed feature, advantage or mode of operation.

The terminology used herein is for the purpose of describing particular embodiments only and is not intended to be limiting of embodiments of the invention. As used herein, the singular forms "a", "an" and "the" are intended to include the plural forms as well, unless the context clearly indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

The following detailed description includes the best currently contemplated mode or modes of carrying out exemplary embodiments of the invention. The description is not to be taken in a limiting sense but is made merely for the purpose of illustrating the general principles of the invention, since the scope of the invention will be best defined by the allowed claims of any resulting patent.

Figure 1:
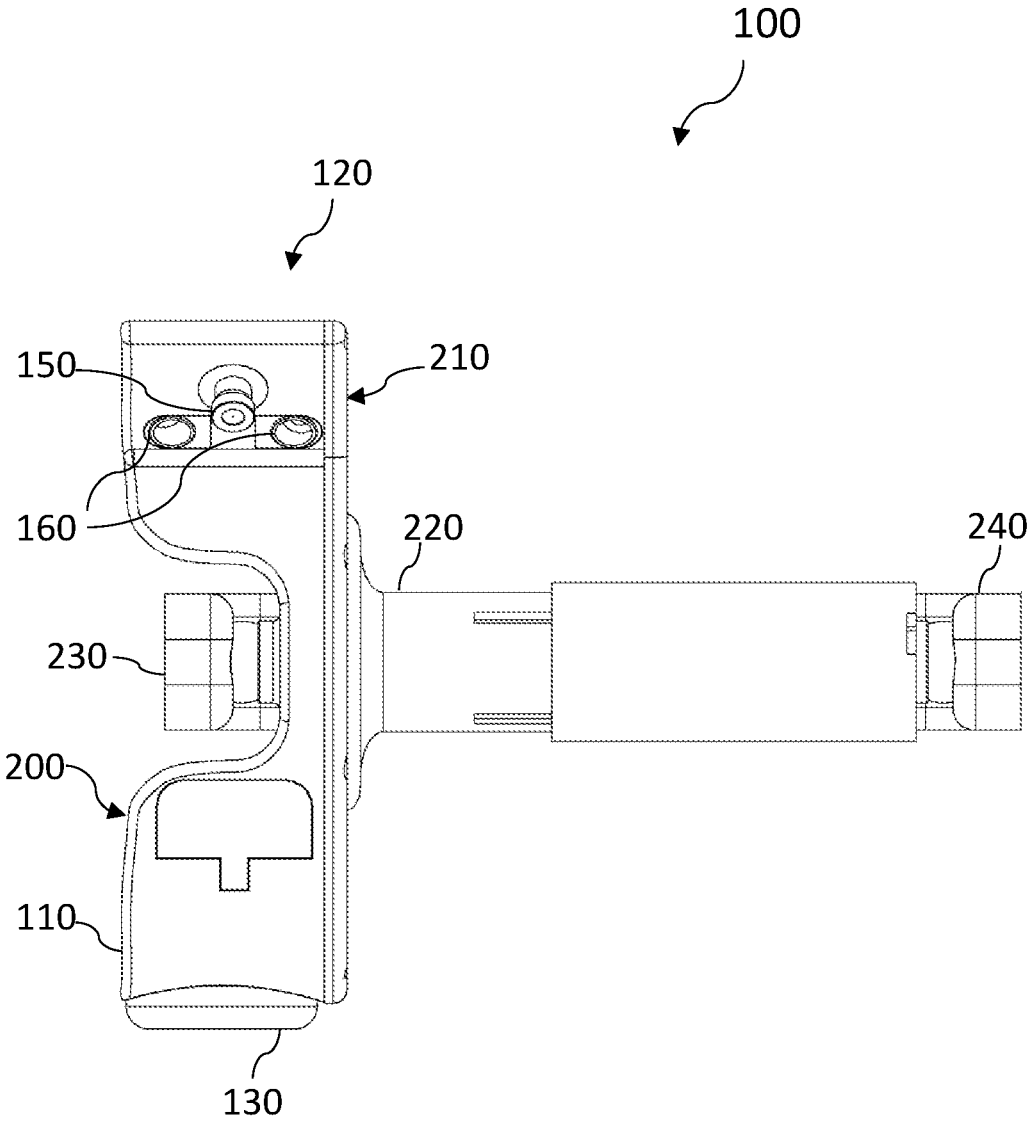
FIG. 1 is a front view of the dispensing assembly, according to an exemplary embodiment of the present invention.
Figure 2:
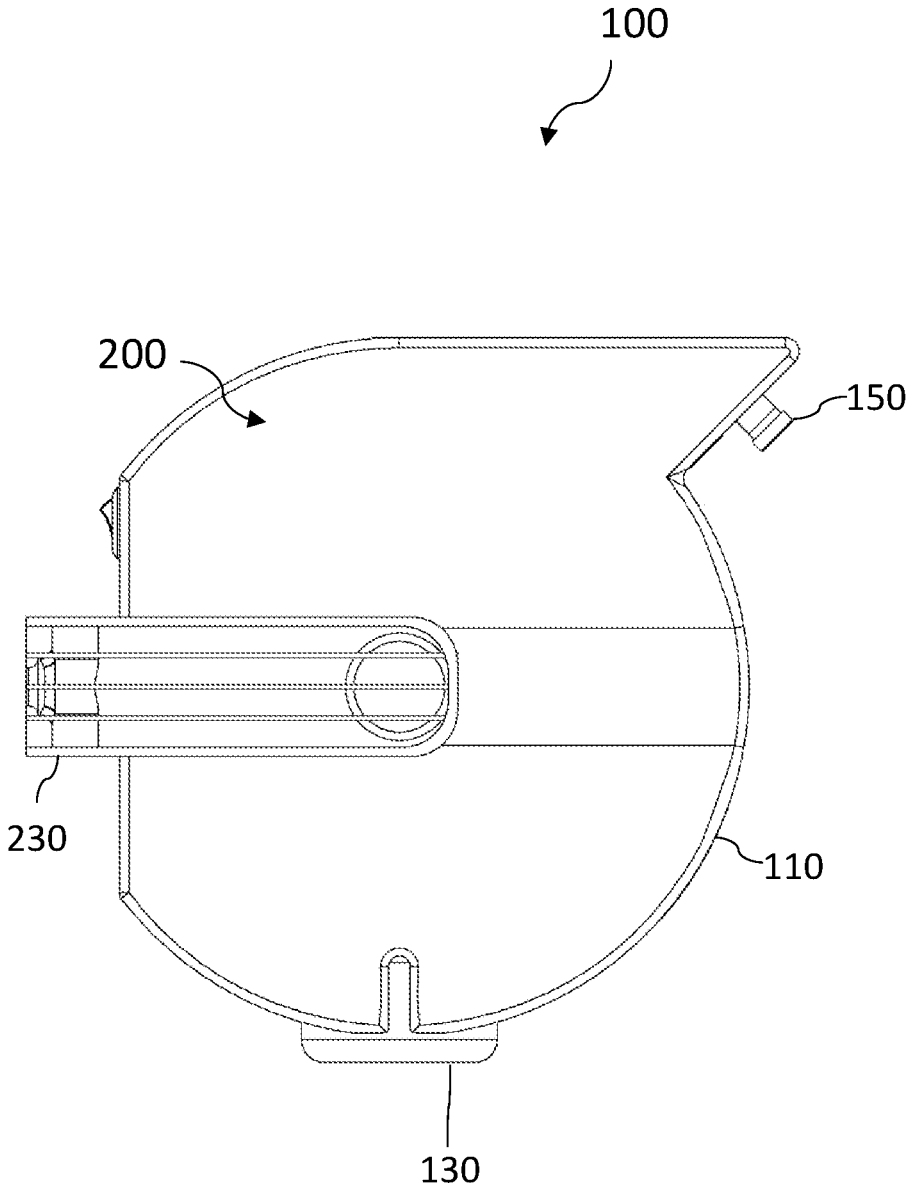
FIG. 2 is a left view of the dispensing assembly, according to an exemplary embodiment of the present invention.
Figure 3:
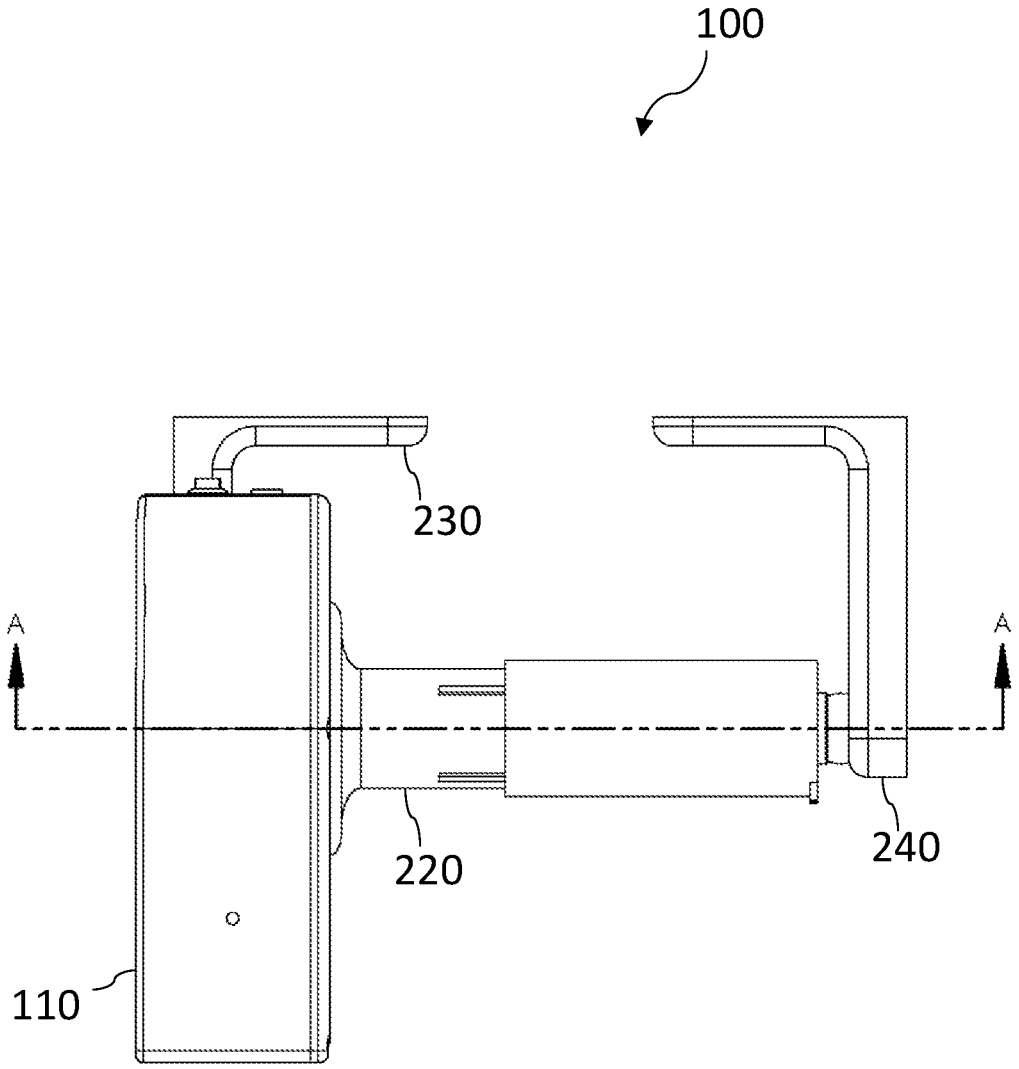
FIG. 3 is a top view of the dispensing assembly, according to an exemplary embodiment of the present invention.
Figure 4:
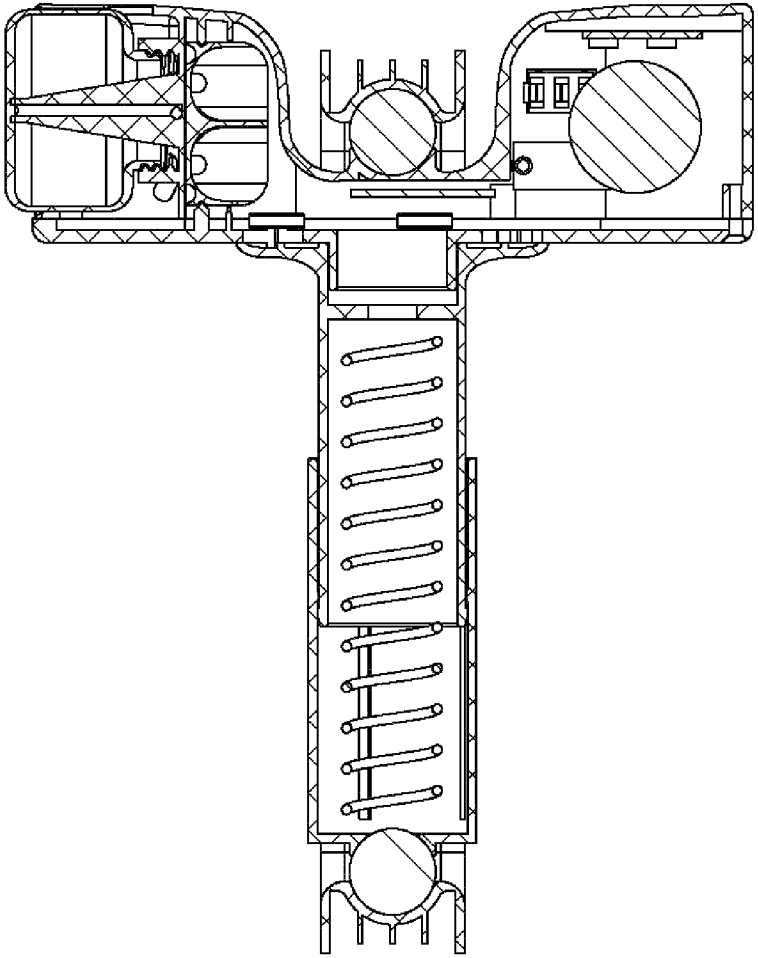
FIG. 4 is a cross-section view of the dispensing assembly as shown in FIG. 3 taken along line A-A, according to an exemplary embodiment of the present invention.
Figure 5:
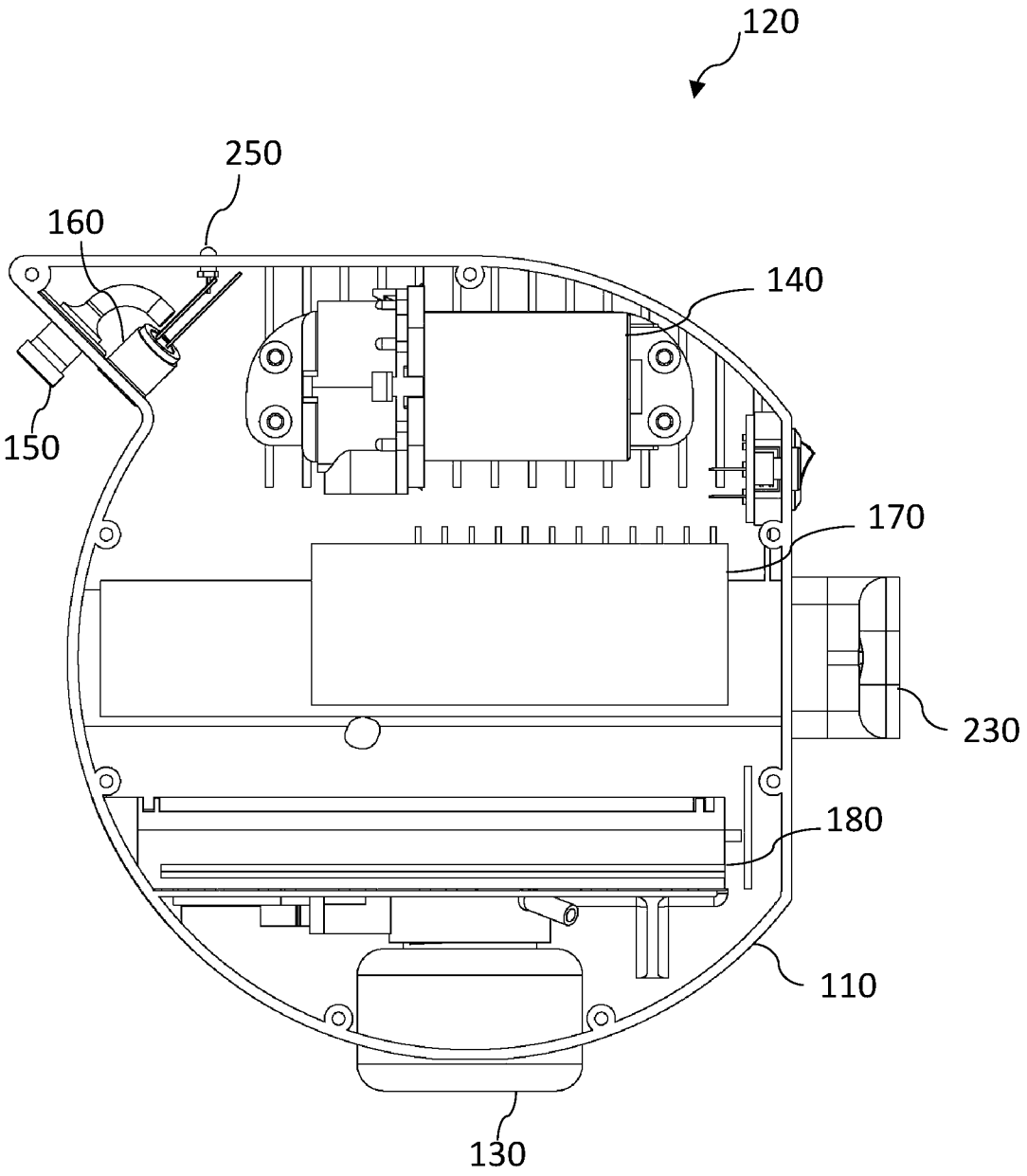
FIG. 5 is a right side view of the dispensing assembly having a right plate removed to show the internal components, according to an exemplary embodiment of the present invention.
Figure 6:
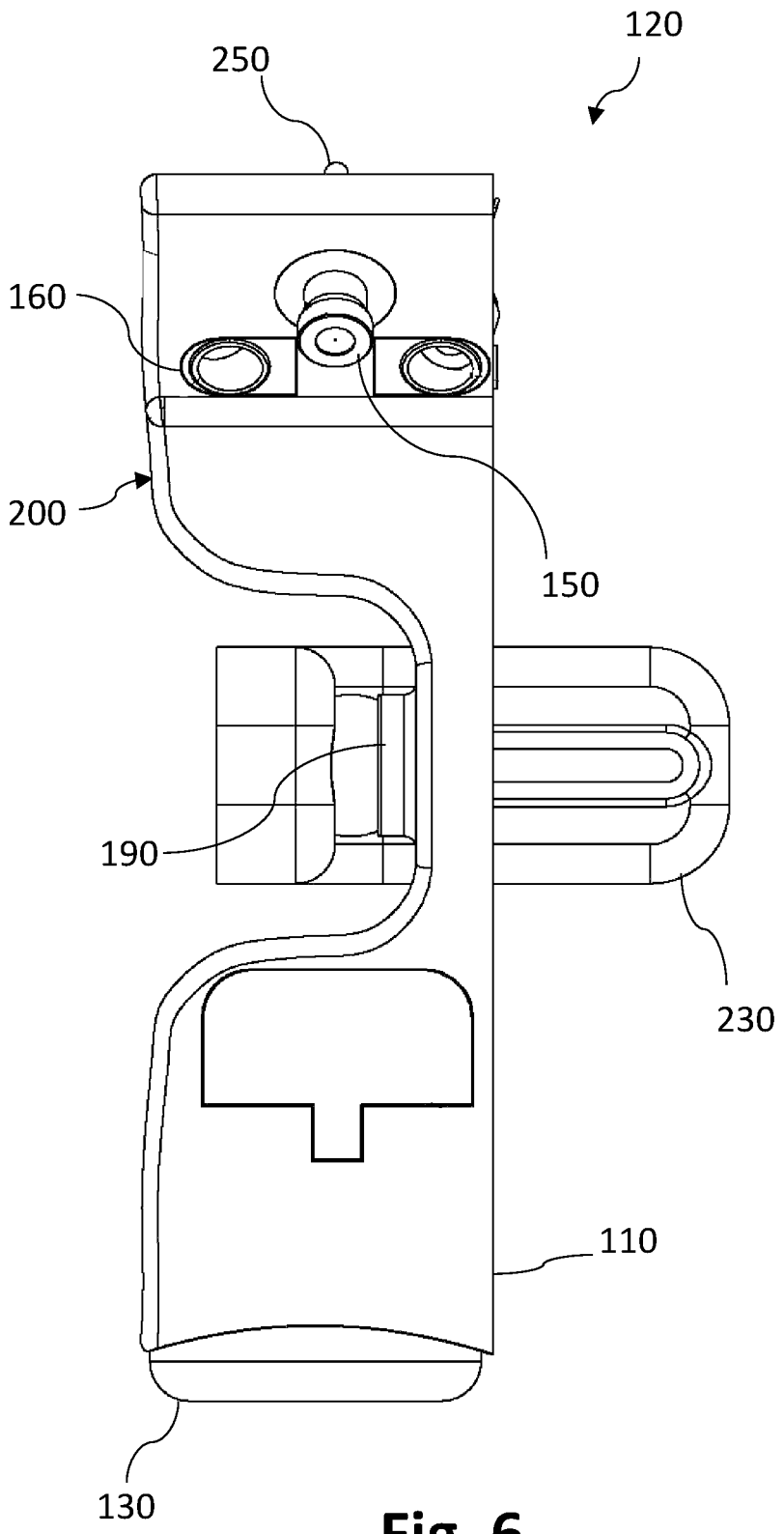
FIG. 6 shows a front side of a liquid dispensing unit of the dispensing assembly, according to an exemplary embodiment of the present invention.
Figure 7:
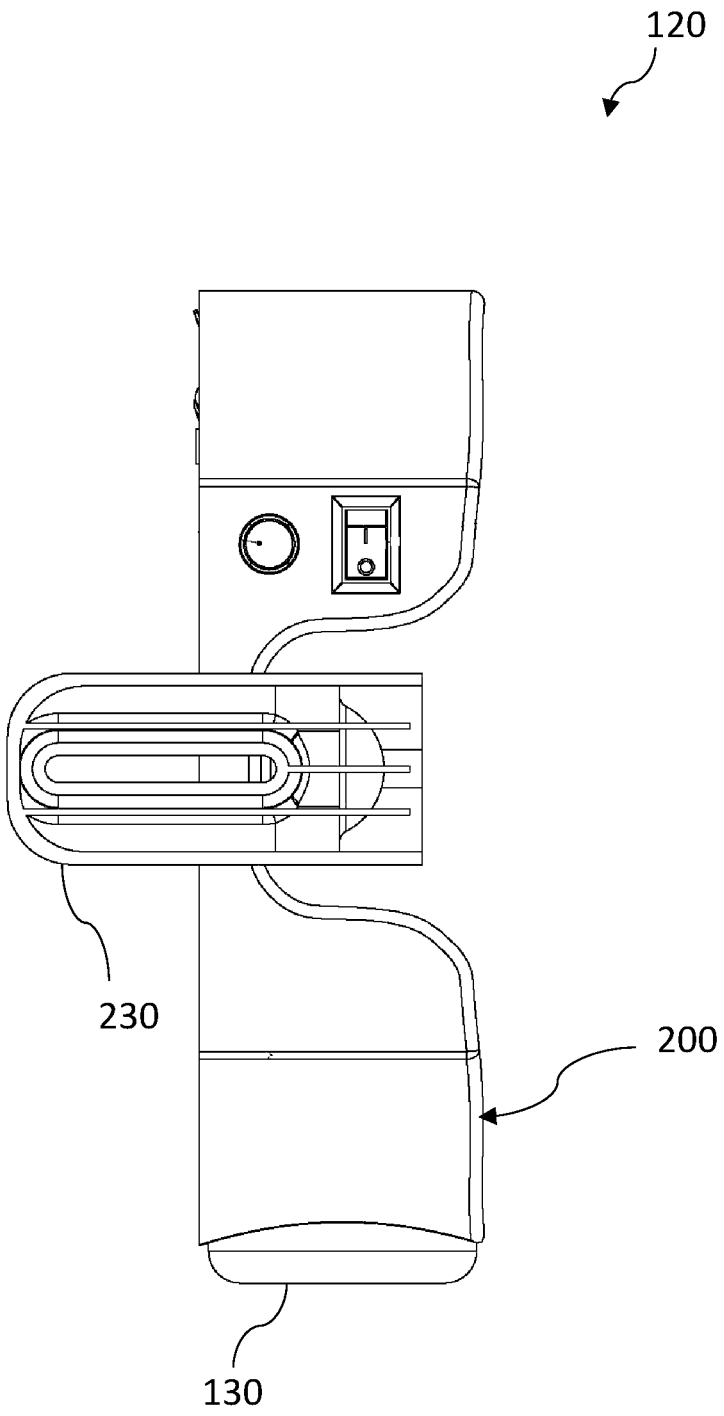
FIG. 7 shows a rear view of the liquid dispensing unit, according to an exemplary embodiment of the present invention.

Disclosed is a dispensing assembly that includes a liquid dispensing unit in combination with a tissue holder. The disclosed assembly is compact and easy to install. Moreover, the disclosed assembly can be mounted to a wall of a washroom and looks aesthetic and luxurious. Referring to FIGS. 1-7 which show an exemplary embodiment of the disclosed assembly 100. The disclosed assembly 100 can include a housing 110 of a liquid dispensing unit 120. The housing 110 can be of a shape resembling a short cylindrical object with a horizontal depression on a left middle portion. The rear of the housing 110 can be flat as shown in the drawings. The dimensions of the housing 110 can be such that to accommodate a tissue roll on either the left side or the right side of the housing 110 and is thus the roundish shape of the housing.

The liquid dispensing unit 120 can include a refillable container 130 at the bottom, more clearly shown in the right side view. The bottom of the housing can include a suitable receptacle to receive and secure the mouth of the container. For example, the suitable receptacle can be a threaded groove in the housing, and threads can also be provided on an outer surface of the mouth of the container. The container can be fastened to the housing such that the threads of the mouth of the container can engage with the threads of the groove. While drawings illustrate a cylindrical shape container, it is obvious to a person reading this disclosure that other shapes of the container are within the scope of the present invention. However, the round shape of the container as shown in the drawings may be preferable for a number of reasons. The container can be unfastened from the housing for cleaning, refilling, and the refilled container can again be fastened to the housing.

The liquid can preferably be water with or without any additives. The additives can include fragrance, hard water treating agents, disinfectants, surfactants, and the like. The additives can be dissolved in the water or suspended in the water. For example, a charcoal absorbent pouch can be dropped in the container for treating the water. The container can be easily removed by grabbing the bottom of the container in a hand and twisting the container. Similarly, the container can be easily coupled by inserting the mouth of the container within the receptacle and twisting the container with the hand in a direction opposite to the direction of opening the container. The directions for opening and closing the container can be shown by arrows disposed over the housing. The container can be cleaned to prevent the deposition of scales on the inner and outer surfaces of the containers. The container can be made from plastic, glass, or metal. Preferably, the container can be made from transparent plastic. The water level in the container can be easily visible from outside in the transparent body of the container. Thus, the container can be removed, and the water level can be checked without disassembling the liquid dispensing unit or the liquid hosing, or the whole dispensing assembly.

The liquid dispensing unit 120 can further include a pump 140 (shown in FIG. 5) to suck water from the container 130 mounted to the housing 110. The pump can be encased within the housing as shown in the drawings. An output of the pump can be connected to a nozzle 150 protruding from the front side of the housing 110. The pump can output the sucked liquid from the container through the nozzle. The nozzle can be configured to dispense a stream of liquid that can be focused on a small area. The stream of liquid sprayed by the nozzle does not diverge significantly and can wet a small area of the toilet paper or any other article. The liquid in the stream of liquid can be in a form of mist or fine droplets.

Nearby the nozzle can be provided sensors 160 to detect the presence of toilet paper in proximity to the nozzle 150. The sensors can be a proximity sensor or a motion sensor, that can detect bringing the toilet paper in front and nearby the nozzle within a threshold range. It is understood that the sensors can detect any object in proximity of the nozzle, such as a hand. However, the sensors can be configured to differentiate the toilet paper or comparable articles. A control unit 170 can control the functioning of the pump and the sensors. The control unit can be implemented in a form of a printed circuit board (PCB) that can be enclosed within the housing 110. The pump and the motion sensors can be electrically connected to the PCB. The sensors can protrude from the housing to detect the presence of toilet paper in the proximity of the nozzle. The instructions to distinguish the toilet paper by the sensors can also be configured in the PCB.

The control unit, the pump, and the motion sensors can be powered by a battery 180 also enclosed within the housing 110. The battery can be a replaceable single-use battery, such as an alkaline battery. The battery can also be a rechargeable battery, such as a lithium-ion battery. The rechargeable battery can be removed from the housing and replaced by a charged battery. Alternatively, charging circuitry can also be provided within the housing to charge the battery from an external power supply. The external power supply can be wired or wireless, and both the wired and wireless power supply is within the scope of the present invention. The charging circuitry can allow charging from either a wired power supply, a wireless power supply, or both. In certain embodiments, the internal battery can be optional, and the disclosed dispensing assembly can be externally powered by the wired or wireless power supply.

The left side of the housing 110 can be provided with a coupling bracket 190. Preferably, the coupling bracket can be provided within the horizontal depression on the left side of the housing 110 as shown in the drawings. The coupling bracket can be removably coupled to the left plate 200 of the housing 110. Alternately, the coupling bracket can be fixedly coupled to the left plate. The left plate may also be removable from the housing. The left plate can be coupled to the hosing through screws, snap-fit, or the like fastening mechanism. Alternatively, the left plate can be integral with the housing to form a single unit. Either the left plate or the right plate can be removable to provide access to the interior of the housing. The right plate 210 can be coupled to the housing 110 similar to the left plate 200.

To the right side of the housing i.e., to the right plate 210 of the housing 110 can be coupled a stem 220 for mounting a tissue roll. The stem 220 can be removably coupled to the right plate 210 using a suitable fastening mechanism. Examples of suitable fastening mechanisms include engaging threads, lock and key, snap-fit, and the like fastening mechanisms. Also, stem 220 can be integral with the right plate 210 to form a single unit. The stem can extend perpendicular to the right plate. The length of the stem can be proportional to a length of a standard toilet paper roll. However, the length of the stem can be varied without departing from the scope of the present invention. Moreover, the stems of different lengths can be interchangeably coupled to the right plate of the housing.

The dispensing assembly 100 can further include a left wall mounting bracket 230 and a right wall mounting bracket 240. The coupling bracket 190 on the left plate 200 can couple to the left wall mounting bracket 230. The free end of the stem 220 can couple to the right wall mounting bracket 240. The left wall mounting bracket and the right wall mounting bracket can be mounted to a wall for mounting the disclosed dispensing assembly to a wall. It is understood, however, that certain embodiments describe the stem to be on the right side of the housing i.e., coupled to the right plate, however, the stem can also be provided on the left plate without departing from the scope of the present invention.

In use, a person can tear a piece of toilet paper from the roll mounted to the stem of the dispensing assembly. The toilet paper can optionally be corrugated by hand. Thereafter, the toilet paper can be bought close to the nozzle. The nozzle upon detecting the presence of the toilet paper can output a stream of liquid focused on a small area of the toilet paper, for example, about 25-50% of the toilet paper. Preferably, the middle of the toilet paper can be exposed to a stream of liquid. The major portion of the toilet paper can remain dry, thus retaining the integrity of the toilet paper in hand and during wiping the inner buttocks. A LED 250 can also be seen protruding from the housing, wherein tuning on of the LED can indicate the dispensing of the stream of liquid.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above-described embodiment, method, and examples, but by all embodiments and methods within the scope and spirit of the invention as claimed.

What is claimed is:

1. A method for maintaining anal hygiene, the method comprising the steps of:

providing a dispensing assembly comprising:

a housing, a container removably coupled to the housing through a mouth of the container, wherein a bottom of the housing has an opening for receiving the container in an upright position, wherein a length of the container is such that a bottom portion of the container remains protruding outwards and downwards from the housing, wherein the bottom portion of the container is configured to be gripped by a human hand for rotating the container, wherein a wall of the housing adjacent to the bottom opening of the housing has an elongated cutout for viewing a level of water in the container from outside of the housing, a pump enclosed within the housing and in fluid communication with an inner volume of the container, and a nozzle in fluid communication with an output of the pump, the nozzle configured to output a stream of liquid sucked by the pump from the container;

positioning a toilet paper in front of the nozzle; and applying the stream of liquid on a portion of the toilet paper to obtain a partially wet toilet paper, wherein the nozzle is configured to dispense a focused stream of liquid for partially wetting the toilet paper, wherein the dispense assembly is configured to dispense a predetermined amount of liquid at a time, wherein the predetermined amount is based on the portion of the toilet paper, wherein the portion is about 25-50% of the toilet paper.

2. The method according to claim 1, wherein the portion is in a middle of the toilet paper.

3. The method according to claim 1, wherein the method further comprises the steps of:

wiping inner buttocks with the partially wet toilet paper.

4. The method according to claim 1, wherein the dispensing assembly further comprises:

a sensor protruding from the housing, the sensor configured to detect the toilet paper when in proximity to the nozzle.

5. The method according to claim 1, wherein the dispensing assembly further comprises:

a stem coupled to a right plate of the housing, the stem configured to mount a roll of toilet paper, wherein the method further comprises the step of:

tearing the toilet paper from the roll of toilet paper.

6. The method according to claim 1, wherein the method further comprises the steps of:

removing the container from the housing;

refilling the container with water; and coupling the container to the housing.

7. A dispensing assembly comprising:

a housing;

a container removably coupled to the housing through a mouth of the container, wherein a bottom of the housing has an opening for receiving the container in an upright position, wherein a length of the container is such that a bottom portion of the container remains protruding outwards and downwards from the housing, wherein the bottom portion of the container is configured to be gripped by a human hand for rotating the container, wherein a wall of the housing adjacent to the bottom opening of the housing has an elongated cutout for viewing a level of water in the container from outside of the housing;

a pump enclosed within the housing and in fluid communication with an inner volume of the container; and a nozzle in fluid communication with an output of the pump, the nozzle configured to output a stream of liquid sucked by the pump from the container, wherein the nozzle is configured to dispense a focused stream of liquid on a portion of the toilet paper for partially wetting the toilet paper, wherein the dispense assembly is configured to dispense a predetermined amount of liquid at a time, wherein the predetermined amount is based on the portion of the toilet paper, wherein the portion is about 25-50% of the toilet paper.

8. The dispensing assembly according to claim 7, wherein the dispensing assembly further comprises:

a sensor protruding from the housing, the sensor configured to detect a toilet paper when in proximity to the nozzle, wherein the sensor is positioned adjacent to the nozzle.

9. The dispensing assembly according to claim 8, wherein the dispensing assembly further comprises:

a stem coupled to a right plate of the housing, the stem configured to mount a roll of toilet paper.

10. The dispensing assembly of claim 9, wherein the housing has a horizontal depression on its left middle portion, wherein the depression is configured to receive a coupling bracket, the coupling bracket is coupled to the left middle portion, the coupling bracket configured to couple to a wall for mounting the dispensing assembly to the wall.

* * * * *